6/24/86 XR 4,597,099

United States Patent [19]

Sawafuji

[11] Patent Number: 4,597,099

[45] Date of Patent: Jun. 24, 1986

[54] PIEZOELECTRIC TRANSDUCER

[76] Inventor: Tadashi Sawafuji, 9-15, Nishi-Sugamo 1-chome, Toshima-ku, Tokyo, Japan, 170

[21] Appl. No.: 586,977

[22] Filed: Mar. 7, 1984

[30] Foreign Application Priority Data

| | | | |
|---|---|---|---|
| Apr. 20, 1983 | [JP] | Japan | 58-59342[U] |
| Apr. 20, 1983 | [JP] | Japan | 58-59343[U] |
| Oct. 14, 1983 | [JP] | Japan | 58-158939[U] |

[51] Int. Cl.[4] ..... H04R 17/00; H04R 1/02

[52] U.S. Cl. ..... 381/90; 179/110 A; 310/313 D; 310/322

[58] Field of Search ..... 381/90; 179/110 A, 111 R, 179/111 E; 310/313 R, 313 D, 317, 322

[56] References Cited

U.S. PATENT DOCUMENTS

| | | | |
|---|---|---|---|
| 3,980,829 | 9/1976 | Beveridge | 181/176 |
| 4,156,800 | 5/1979 | Sear et al. | 310/322 |
| 4,270,023 | 5/1981 | Beveridge | 179/146 E |

*Primary Examiner*—Gene Z. Rubinson
*Assistant Examiner*—Danita R. Byrd
*Attorney, Agent, or Firm*—Wegner & Bretschneider

[57] ABSTRACT

A crystal sound producer has a piezoelectric crystal plate diaphragm which produces sound waves when applied with a voltage thereacross. A waveform transform plate has slits or linear grooves through which the sound waves from the diaphragm are radiated in semicylindrical waves. As these semicylindrical waves propagate in the air, they superpose one another to form generally plane waves which sound natural to the human hearing. The crystal sound producer can be used in portable articles such as badges.

9 Claims, 17 Drawing Figures

PIEZOELECTRIC TRANSDUCER

FIELD OF THE INVENTION

The present invention relates to a novel sound producer using a piezoelectric crystal diaphragm, and further to articles incorporated therewith.

BACKGROUND OF THE INVENTION

A piezoelectric crystal diaphragm, a thin plate of a piezoelectric crystal, such as quartz, or barium titanate, provided with electrodes on both sides, undergoes changes in thickness when subjected to potential differences between the electrodes—piezoelectric effect—. Such piezoelectric diaphragms generally have high resonance frequencies and have been used, as a device for converting electrical signal energy into sound, only in tweeters, i.e. loudspeaker for handling only the higher audio frequencies, or in other simple sound producers.

The piezoelectric crystal diaphragm has been frequently accommodated in a thin, flat casing with a small circular opening formed in the center of its wall, arranged such that the sound waves uttered from the diaphragm are radiated through the circular opening. In such a case, the circular opening in the arrangement serves as a point sound source through which the sound waves from the diaphragm emerge out of the casing in generally spherical wavefronts. These sound waves with generally spherical wavefronts, like those peculiar to a point-sound-source loudspeaker such as a cone type dynamic loudspeaker, accompany sound pressures propagating at different velocities from those of the vibrating particles in the air, so that they sound somewhat unnatural to the human ear. On the other hand, the sound waves from the point sound source tend to rapidly diffuse and damper in the air, and thus the frequency band obtained is narrow.

In the prior art arrangements, the piezoelectric crystal diaphragm tends to vibrate in different phases at its different portions (split vibrations) and the resonance frequencies which cause such split vibrations are high, so that the fidelity of the reproduction is good only for high audio frequencies.

SUMMARY OF THE INVENTION

An object of the present invention is to provide a sound producer using a piezoelectric crystal diaphragm which is capable of sounding natural to the human ear with sufficient sound pressure levels.

Another object of the present invention is to provide a portable article which is incorporated with such an improved crystal sound producer.

In order to achieve these objects, the invention provides a crystal sound producer having means for providing one or more linear sound sources through which the sound waves uttered from the diaphragm are reradiated substantially in semi-cylindrical wavefronts, the diaphragm being driven in response to a signal from a signal source, such as audio memory circuits, microphones, radio receivers, record players, and magnetic tape recorders/reproducers.

In a preferred embodiment of the sound producer of the invention, the sound sources comprise slits formed in the central portion of a waveform transform sheet positioned in front of the diaphragm.

In another preferred embodiment, the sound sources comprise slits formed in the central portion of a waveform transform sheet secured on the front face of the diaphragm, the waveform transform sheet being made of a hard synthetic resin, either foamed or solid.

In another embodiment, a waveform transform film made of a hard synthetic resin and having parallel ridges raised on one face is secured to the front face of the diaphragm.

In another embodiment, a waveform transform sheet made of a foamed, hard synthetic resin is secured to the front face of the diaphragm. The sheet has a plurality of parallel neighboring ridges and a plurality of parallel grooves between the ridges on one face, and the sheet further has a slit formed through it at a portion where the central groove lies.

In another embodiment, the diaphragm and a waveform transform film are secured via the edge portions of the diaphragm to a mounting in side-by-side relationship. The film is made of a hard synthetic resin and has parallel ridges raised on one face and an annular peripheral ridge raised on the same face and surrounding the parallel ridges. A connecting member is interposed between the diaphragm and the waveform transform film at their central portions, so as to transmit mechanical vibrations between them.

In another embodiment, the piezoelectric crystal diaphragm comprises a plurality of series-connected piezoelectric crystal plate elements, and is secured at one end to an inner rear wall of a housing which is open at its front. The means for providing one or more linear sound sources comprises a waveform transform plate provided in the housing and having a generally V-shaped cross section, with the shanks of the V bulging generally outward of the housing. A first edge of the waveform transform plate corresponding to the bottom of the V is secured to the diaphragm, while both side edges of this plate parallel to the first edge are secured to their respective side walls of the housing in proximity to the open front of the housing.

DESCRIPTION OF THE DRAWINGS

The present invention will now be described, by way of examples, with reference to the accompanying drawings, in which.

DETAILED DESCRIPTION OF THE PREFERRED EMBODIMENTS

Figure 1:
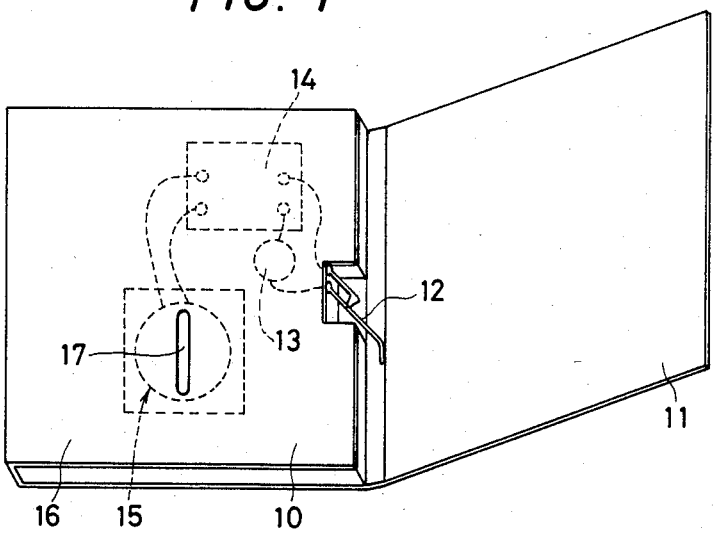
FIG. 1 is a schematic perspective view of a casing for cards, incorporating an embodiment of the crystal sound producer according to the invention.
Figure 2:
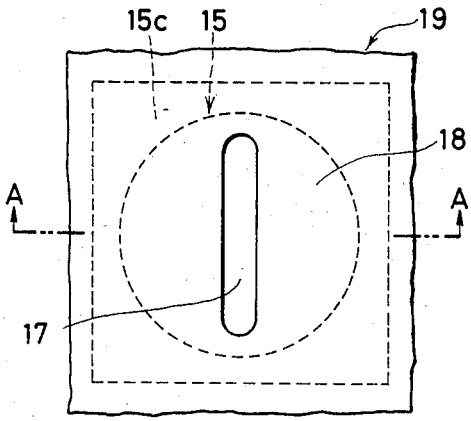
FIG. 2 is an enlarged partial plan view of the casing of FIG. 1.
Figure 3:
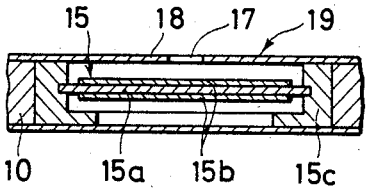
FIG. 3 is a cross sectional view taken along lines A—A of FIG. 2.

In FIGS. 1 to 3, a first embodiment of the crystal sound producer is shown incorporated in a casing for cards. The casing comprises a thin, box-like body 10 made of a suitable material, such as paperboard, wood, or a hard, foamed synthetic resin. A lid 11 made of paper or a hard synthetic resin is hinged to the body 10 so that it can open and close the box-like body 10. The sound producer is provided in the body 10, and includes a piezoelectric crystal diaphragm 15, a power supply 13, an electric circuit comprising an audio memory circuit 14 energized by the power supply 13 for applying a voltage across the diaphragm, and a switch 12 between the power supply and the circuit 14. The switch 12 has a lever 12 engaging at its one end to the lid 11 so as to be actuated by the motion of the lid 11 in such a manner that, when the lid 11 is in its closed position, the switch 12 is off and prevents the supply of power 13 to the circuit 14 and, when the lid 11 is in its open position as shown in FIG. 1, the switch 12 is on and allows the supply of power to the circuit 14. When the casing is opened, the circuit 14 is energized by the power supply 13 and thus the disk-shaped diaphragm 15 is driven by the voltage from the circuit, which voltage changes according to the data or audio information stored in the circuit 14.

The diaphragm 15 comprises a plate 15*a* of a known piezoelectric crystal, such as barium titanate, provided with an electrode 15*b* on each side. The diaphragm 15 changes in thickness in response to the audio frequency signal from the circuit 14, and thus utters sound waves of audio frequencies.

As shown in FIG. 3, the diaphragm 15 is restrained at its periphery by a mounting 15*c* within the box or body 10. A wall 18, parallel to the diaphragm 15, of the box 10 is formed with a slit 17 which is 0.5 to 3 mm wide and has a length equal to or slightly shorter than the diameter of the diaphragm 15. The slit 17 extends directly over the center of the disk diaphragm 15.

The sound waves uttered from the diaphragm 15 are spherical waves peculiar to a point sound source. These spherical waves are restricted when passing through the slit 17, so that they emerge out of the casing in semicylindrical wavefronts which may be considered close to plane waves. Thus, the diaphragm 15, which in fact may be considered to be a point sound source, can serve as a linear sound source by virtue of the presence of the slit 17. The sound waves uttered from the sound producer 19 including the diaphragm 15 and the slit 17, accompany sound pressures propagating at the same velocities with vibrating particles in the air, so that the sound producer 19 can give natural sounds. In addition, the directivity patterns of the sound producer 19 have higher peaks frontward than in the absence of the slit 17, and the semicylindrical waves will damp as they propagate in the air at half the damping ratio of the spherical sound waves.

As described above, the crystal sound producer 19 is capable of giving natural sounds,in a wide frequency range, with high sound pressure levels. A liquid, such as silicone oil, may be provided on the electrode 15*b* opposite to the slit 17, so as to further improve quality of the sounds. This will suppress the aforementioned split vibrations of the diaphragm 15, and will reduce their resonance frequencies. In other words, the application of the liquid will provide for shortage of the reproducing power in the middle and lower audio frequencies, and thus will serve for eliminating metallic sound components in reproduced sounds. Instead of the liquid, a wavy piece of Mylar (polyester) film may be bonded to the electrode 15*b* underneath the slit 17.

Figure 4:
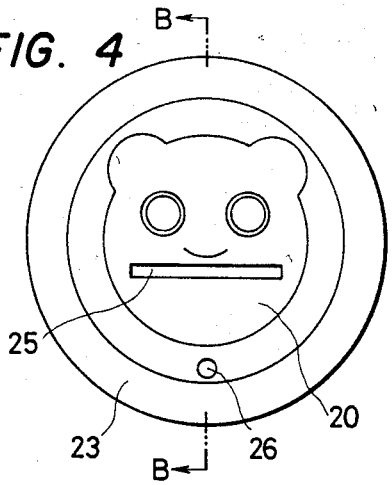
FIG. 4 is a plan view of a badge incorporating another crystal sound producer.
Figure 5:
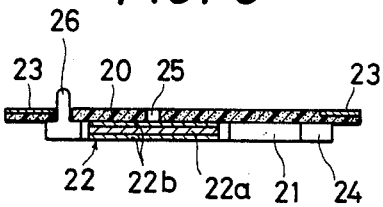
FIG. 5 is a cross sectional view taken along lines B—B of FIG. 4.
Figure 6:
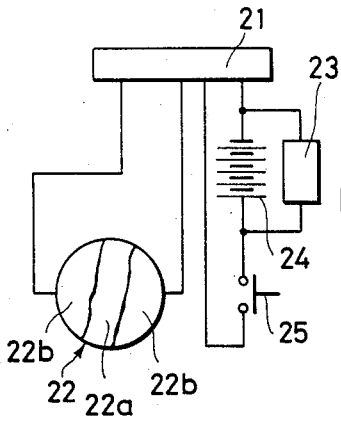
FIG. 6 is a circuit diagram of the sound producer of FIG. 4.

In FIGS. 4, 5, and 6, a second embodiment of the crystal sound producer is shown incorporated in a portable article, in this example a generally disk-shaped badge. The sound producer includes an electric circuit comprising an audio memory circuit 21, and a piezoelectric crystal diaphragm 22, which are both mounted on the back side of a front plate 20 of the badge. These 21 and 22 are similar to the circuit 14 and the diaphragm 15 of the first embodiment. Power is supplied to the circuit 21 from a solar battery 23 arranged along the peripheral portion of the front side of the plate 20, and a storage battery 24 connected in parallel with the solar battery 23. The storage battery 24 is mounted in the badge.

The front panel 20 bears a design of a popular mascot at its front side as shown in FIG. 4, and has a slit 25 formed at the portion corresponding to the mouth of the mascot. The slit 25 is 0.5 to 3 mm long, and is slightly shorter than the diameter of the diaphragm 22. Ni-Cd (Nickel-Cadmium) storage cells may be used as the battery 24. The circuit 21 may comprise an integrated circuit available on the market, such as Model SVM 7955 available from Sanyo Electric Co., Ltd., Osaka, Japan. As can be understood from FIG. 6, the circuit 21 is turned on by actuating a push-button switch 26, and supplies to the diaphragm 22 an audio frequency signal voltage corresponding to the voice or music stored in the circuit 21.

The diaphragm 22, similar to the one 15 of the first embodiment, comprises a plate 22*a* of a piezoelectric crystal, such as barium titanate, provided an electrode 22*b* on each side. The diaphragm 22 has its center aligned with the center of the slit 25, and the sound waves uttered from the diaphragm 22 are radiated through the slit 25 frontward of the front panel 20. Thus, the sound waves emerge out of the slit 25 in substantially semicylindrical waves, so that the peaks in the higher audio frequency range, near the resonance points peculiar to the piezoelectric diaphragm, are effectively eliminated, and at the same time cancellation between waves in the lower audio frequency range vanishes, whereby uniform sound pressure levels can be obtained. Thus, the sound producer can utter mild sounds depending on the sound or music stored in the circuit 21.

In this embodiment, the front panel 20 comprises a sheet 2 to 5 mm thick, made of a hard, foamed synthetic resin, such as polystyrene, nylon, polycarbonate, or polyester. Alternatively, the front panel may comprise a solid sheet 0.5 to 2 mm thick, made of one of such synthetic resins, or may also comprise a sheet of hard paper 0.5 to 2 mm thick.

The combination of the solar battery 23 and the storage battery 24 may be substituted by disposable storage cells.

The embodiment of the sound producer may be incorporated in various articles other than a badge, such as emblems, pendants, lighters, key holders, cards, and cosmetics. The sound producer can give to these articles an ability of "speech".

The slit 25 may also be in other forms than a generally rectangular opening. It may be arcuate, wavy, or V-shaped, for example. The front panel 25 may have two or more such slits 25.

Figure 7:
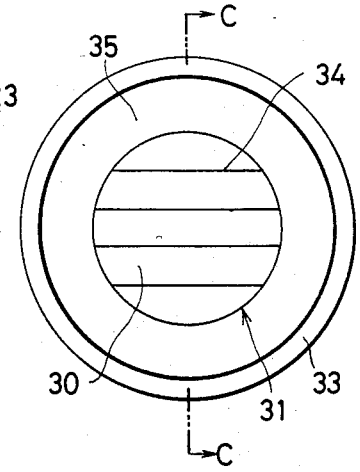
FIG. 7 is a plan view of another embodiment of the crystal sound producer according to the present invention.
Figure 8:
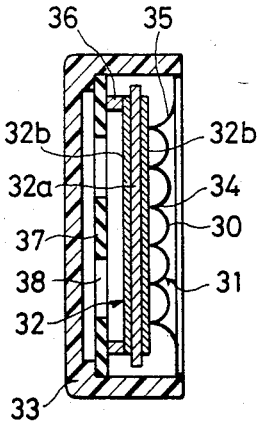
FIG. 8 is a cross sectional view taken along lines C—C of FIG. 7.

In FIGS. 7 and 8, a third embodiment of the crystal sound producer of the invention is shown. This embodiment has a generally pan-shaped mounting 33 of a hard synthetic resin. A piezoelectric diaphragm 32 is accommodated in the mounting 33. A waveform transform film 31 made of a hard synthetic resin is secured to the front face of the diaphragm 32. This film 31 has parallel ridges raised on its one face away from the diaphragm 32. The ridges 30 are formed parallel interspaced with grooves 34 that are equally-spaced. The bottoms of these grooves 34 serve as linear sound sources.

The diaphragm 32 comprises a plate **32*a* of a known piezoelectric crystal, such as barium titanate, provided with an electrode 32*b* on each side. The diaphragm 32** changes in thickness in response to an audio frequency signal voltage applied, and reproduces the voice or music.

The waveform transform film 31 is generally of the size of the diaphragm 32, but has a thickness of 10 to 200 micrometers. The film is made of a hard synthetic resin, such as polystyrene, nylon, polycarbonate, or polyester. The cross section of the hollow ridges 30 may be semicircular, as shown in FIG. 8, or triangular, polygonal, or semielliptic. The film 31 is secured to the diaphragm 32 by bonding, and vibrates with it. The outer annular edge portion 35 of the film 31 is secured at its periphery to the inner wall surface of the mounting 33, as shown. The various features 30 and 35 of the film 31 are formed by pressing.

The diaphragm 32 is secured at its rim to an annular support 36 which in turn is secured to a rear plate 37. The plate 37 is secured at its rim to an annular shoulder portion of the inner wall of the mounting 33, and is formed with vents 38.

When the crystal sound producer of FIGS. 7 and 8 is used as a sound producer in an earphone, the two electrical connections from the earphone terminals are connected, as far spaced apart from each other as possible, so as to allow the diaphragm plate **32*a*** to be capacitive up to the higher audio frequency range.

Stiffness reducing effect and split-vibrations suppressing effect of the waveform transform film 31 reduce the resonance frequency of diaphragm 32 and correspondingly improve the reproduction in the lower audio frequency range. The plurality of the ridges 30 provide a large effective sound-uttering area which ensures that sufficient sound pressures can be obtained with a relatively weak audio signal. In addition, the piezoelectric crystal has a small electrical impedance. Thus, the embodiment may be used preferably in earphones of low power consumption.

The plurality of the equally-spaced grooves 34 each serve as a linear sound source which radiates semicylindrical waves. These waves from the plurality of the linear sound sources 34 will aggregate into plane waves, which will propagate with smaller damping ratios.

Figure 9:
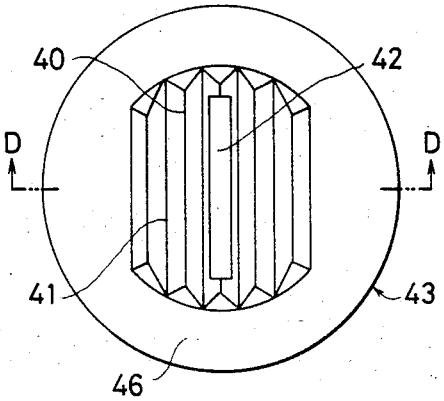
FIG. 9 is a plan view of another embodiment of the crystal sound according to the invention.
Figure 10:
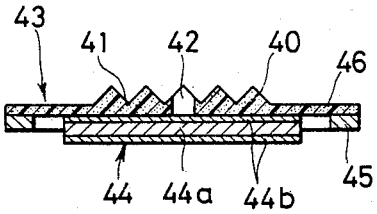
FIG. 10 is a cross sectional view taken along lines D—D of FIG. 9.

FIGS. 9 and 10 show a fourth embodiment of the crystal sound producer of the invention. A waveform transform sheet 43 made of a foamed, hard synthetic resin, is secured to the front face of a piezoelectric crystal diaphragm 44. The sheet 43 has a plurality of parallel neighboring ridges 40 and a plurality of parallel grooves 41 between these ridges on one face of the sheet. The sheet 43 has a slit 42 at a portion where the central one of the grooves 41 is. These grooves 41 and slit 42 serve as linear sound sources. An annular reinforcement 45 is secured to the back side of the sheet 43 at the rim.

The diaphragm 44 is of an identical construction with the diaphragm 32 of the embodiment of FIGS. 7 and 8, and comprises a piezoelectic crystal plate **44*a* provided with an electrode 44*b*** on each side.

The waveform transform sheet 43 comprises a sheet which has a thickness of 2 to 5 mm, and is made of a foamed, hard synthetic resin, such as polystyrene, nylon, polycarbonate, or polyester.

The cross section of the ridges 40 may be triangular, as shown in FIG. 10, or polygonal, semicircular, or semielliptic. The sheet 43 is secured to the front surface of the diaphragm 44 using a bonding agent. The central portion of the waveform transform sheet 43, where the ridges 40 are formed, and the diaphragm 44 can vibrate as a one body.

The waveform transform sheet 43 with the slit 42 can be formed by pressing the material.

This embodiment has similar merits to those of previous embodiment of FIGS. 7 and 8.

Figure 11:
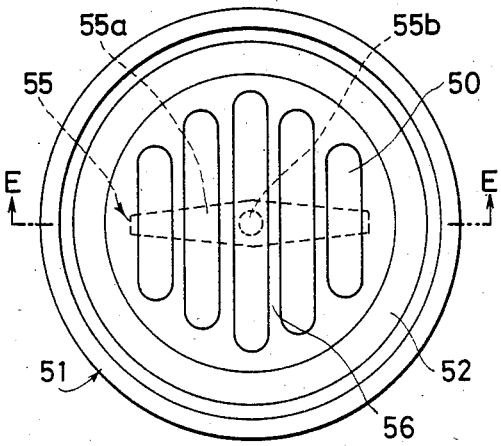
FIG. 11 is a plan view of another embodiment of the crystal sound producer according to the invention.
Figure 12:
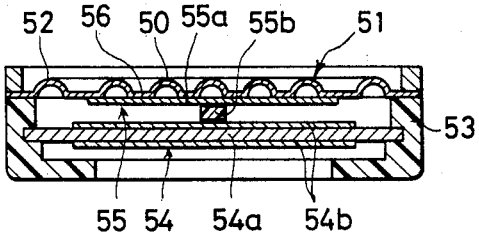
FIG. 12 is a cross sectional view taken along lines E—E of FIG. 11.

FIGS. 11 and 12 show a fifth embodiment of the crystal sound producer of the invention. In this embodiment, a piezoelectric crystal diaphragm 54 and a waveform transform film 51 are secured at their rims to an annular side wall of a generally pan-shaped mounting 53 of a hard synthetic resin, in side-by-side relationship. The film 51 has a plurality of parallel ridges 50 and an annular peripheral ridge 52, both raised on one surface of the film away from the diaphragm 54. A connecting member 55 is interposed between the diaphragm 54 and the waveform transform film 51 at their central portions, so that the vibrations of the central portion of the diaphragm 54 are transferred to the film 51 all over. Thus, the elongate, parallel, equally spaced grooves 56 defined between the raised ridges 50 each serve as a linear sound source.

The waveform transform film 51 has a thickness of 10 to 200 micrometers, and is made of a hard synthetic resin, such as polystyrene, nylon, polycarbonate, or polyester. The cross section of the ridges 50 may be triangular, polygonal, semicircular, or semielliptic. The width of the bottom of the grooves 56 between the ridges 50 is 0.5 to 2.0 mm. The cross section of the annular peripheral ridge 52 may be semicircular, semielliptic, or sawtoothed. The parallel ridges 50 and the annular surrounding ridge 52 are formed by pressing.

The diaphragm 54 comprises a piezoelectric crystal plate **54*a* provided with an electrode 54*b*** on each side.

The connecting member 55 comprises a generally rectangular flat plate **55*a* extending transversely over the parallel ridges 50 and secured to the waveform transform film 51 using a bonding agent, and a boss 55*b* projecting from the central portion of the flat plate 55*a* and secured to the central portion of the diaphragm 54**.

The flat plate 55*a* has a thickness of 10 to 100 micrometers, and is made of a hard, light metal, such as titanium. Alternatively, the flat plate 55*a* may have a thickness of 20 to 50 micrometers, and is made of a hard, light synthetic resin, such as nylon or polyester.

The connecting member 55 provided between the piezoelectric diaphragm 54 and the waveform transform film 51 will transmit the vibration of the diaphragm 54 caused by voice signal from voice memory circuit, microphone, receiver, record player, tape recorder etc. to the waveform transform film 51, and vibration focusing onto the boss 55*b* to cause the film 51 to vibrate uniformly all over. This arrangement ensures that the film 51 will not undergo the phenomenon of "split vibrations" under the influence of the diaphragm. The resonance frequency of the film 51 is relatively low, so that the arrangement ensures improvement in the quality of reproduction in the middle and lower audio frequency ranges. On the other hand, the film 51 will vibrate with the central portion of the disk-shaped diaphragm 54, i.e. the loop of the vibrations, which ensures large amplitudes of the film 51 and therefore sufficient sound pressures.

The parallel, equally spaced grooves 56 between the parallel ridges 50, among various portions of the waveform transform film 51, will produce sound waves which accompany the largest pressure changes, so that the grooves 56 each may be considered a linear sound source which radiates semicylindrical waves. Thus, the semicylindrical waves of the same phases from the array of the parallel linear sound sources 56 will aggregate or combine together to form ideal plane waves. For this reason, the crystal sound producer can give natural sounds, unlike point sound sources such as cone type speakers which utter spherical waves.

In the arrangement of FIGS. 11 and 12, the boss 55*b* of the connecting member 55 is secured to the central portion of the electrode 54*b* of the diaphragm 54. The boss 55*b*, however, may be positioned slightly off from the center. On the other hand, various shapes of the flat plate portion 55*a* of the connecting member 55, other than the generally rectangular shape as shown, are possible: various polygonal, circular, or elliptic shapes, for example.

Figure 13:
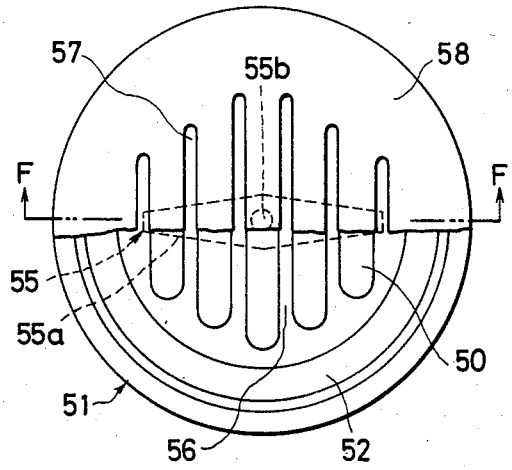
FIG. 13 is a plan view, partly in section, of another embodiment of the crystal sound producer according to the invention.
Figure 14:
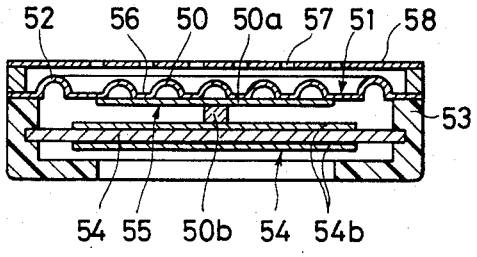
FIG. 14 is a cross sectional view taken along lines F—F of FIG. 13.

FIGS. 13 and 14 show a sixth embodiment of the crystal sound producer. This embodiment is of the same construction with the last described embodiment of FIGS. 11 and 12, except that it is provided with a protective plate 58. This protector 58 is secured to the mounting 53, in close proximity to the front face of the waveform transform film 51. This plate 58 may be made of a metal such as aluminum, or a hard synthetic resin, and has a thickness of 0.2 to 1.0 mm. The protector 58 has a plurality of parallel, equally spaced slits 57 having a width of 0.5 to 2.0 mm and a length roughly equal to that of the grooves 56. These slits 57 may be parallel or oblique with respect to the grooves 56 of the waveform transform film 51.

Plane sound waves from the waveform transform film 51 become semicylindrical waves on passing through the parallel, equally spaced slits 57, and these semicylindrical waves combine together or superpose one another as they propagate, to again form plane waves.

The protective plate 58 will serve for protecting the waveform transform film 51 against damage. This plate 58 also serves for providing for possible deformation of the film 51, which can arise as time passes, due to its internal strains produced upon its pressing; if the plane waves from the waveform transform plate 51 should be distorted by split vibrations of the plate 51 due to its deformation, the parallel slits 57 in the protective plate 58 will serve for again forming plane waves.

All the components of this embodiment, except the protective plate 58, are identical with correspondingly referenced components of the previous embodiment as shown in FIGS. 11 and 12. Therefore, further detailed descriptions regarding such components will not be given.

Figure 15:
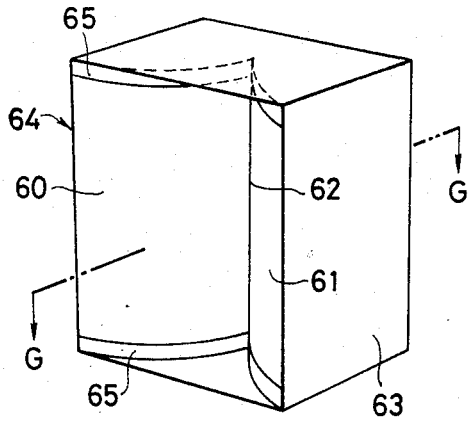
FIG. 15 is a perspective view of another embodiment of the crystal sound producer according to the invention.
Figure 16:
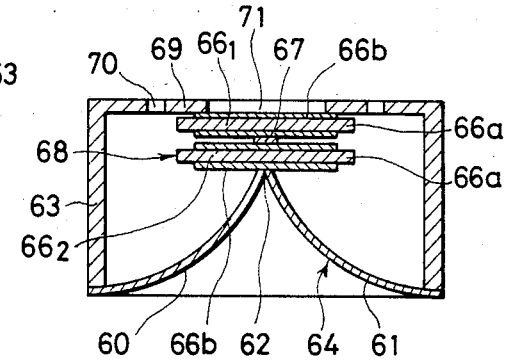
FIG. 16 is a cross sectional view taken along lines G—G of FIG. 15.
Figure 17:
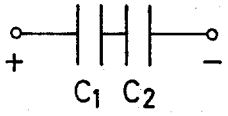
FIG. 17 is a diagram showing an equivalent circuit to a piezoelectric crystal diaphragm which comprises two piezoelectric crystal plate elements.

FIGS. 15, 16, and 17 show a seventh embodiment of the crystal sound producer of the invention. In this embodiment, a generally rectangular housing 63 is provided, which is open at its front. This housing accomodates a waveform transform plate 64 comprising two similar rectangular flexible plate segments 60 and 61. These plate segments are connected together at their rear rectilinear edges 62 to form an integral plate 64. The plate 64 has a generally V-shaped cross section, with the shanks of this V bulging generally outward of the housing 63. The opposite sides of the plate segments 60 and 61 are spaced apart from each other, and are secured to the inner side walls of the housing 63 in proximity to the open front of the housing. The bottom of the V, i.e. the connected edges 62, can be driven in the frontward and rearward directions by a piezoelectric crystal diaphragm 68 mounted on the inner wall surface of a rear panel 69 of the housing 63, so that they can radiate sound waves generally frontward.

The upper and lower edges of the plate 64 are resiliently connected to the inner walls of the housing 63 by means of edge members 65 made of an elastic material such as rubber.

In this embodiment, the piezoelectric crystal plate diaphragm 68 comprises a plurality of piezoelectric crystal plate elements 66*a*. These plate elements 66*a* are each provided with electrodes 66*b* on both sides, and are series-connected together via a conductor 67. An audio frequency signal is applied between the outermost ones of the electrodes 66*b* of the diaphragm 68.

The edge 62 of the waveform transform plate 64 is secured to the opposite electrode 66*b* of the diaphragm 68, and serves as a linear sound source.

The rear wall 69 of the housing 63 has vents 70, through which the electrical connections to the diaphragm 68 pass.

As shown in FIG. 17, the impedance $C_0$ of the piezoelectric crystal diaphragm 68 is expressed by a series resultant capacity of the capacitive impedances $C_1$ and $C_2$ of the piezoelectric crystal plate elements 66*a*:

$$C_0=(C_1 C_2)/(C_1+C_2)$$

The resultant capacity $C_0$ is smaller than the $C_1$ or $C_2$ of a single crystal plate element 66*a*. This means that the compound diaphragm 68 is capable of converting a given amount of power into a larger amount of energy of vibrations than a diaphragm consisting of a single piezoelectric crystal plate. In addition, a voltage applied across a compound diaphragm is shared between the component crystal plates, so that it is possible to apply a higher voltage across a compound diaphragm than a single element diaphragm. Thus, the allowable maximum voltage for the compound diaphragm 68 is higher, which allows the diaphragm 68 to vibrate more strongly in response to a larger input.

The two piezoelectric crystal plates 66a both change in thickness in response to an audio frequency electrical signal applied. The vibrations of the plates 66a thus caused are transferred to the waveform transform plate 64 at its edge 62, so that the flexible plate segments 60 and 61 will vibrate in phase with each other.

The ratios of the displacements of the central portions of the plate segments 60 and 61, to the displacement of the plate edge 62, are large, so that weak input voltages will result in sufficient sound pressure.

The sound waves obtained by the vibrations of the plate 64 are semicylindrical waves centered at the plate edge 62.

The space inside the housing 63 communicates with the air via the vents 70 and an opening 71 formed in the rear wall panel 69 behind the piezoelectric crystal diaphragm 68, whereby occurrence of reduced pressures, which can obstruct the vibrations of the diaphragm 68, can be avoided, and at the same time contact of the diaphragm 68 and the rear wall panel 69 can be avoided. The elastic edge members 65 supporting the upper and lower edges of the waveform transform plate 64, prevent sound leakage at the edges of the plate 64, so that the efficiency of the electro-acoustic conversion is high.

The piezoelectric crystal diaphragm 68 can be made thin, and is of a simple construction. In addition, an efficient waveform transform plate 64 is driven for producing sound waves. Thus, not only the higher audio frequency range, but also the middle and the lower audio frequency ranges can well be reproduced.

The piezoelectric crystal plate 66a of the diaphragm 68 may be made of various piezoelectric crystals other than barium titanate. For example, a substance which exhibits "longitudinal piezoelectric effect", such as quartz, may be used. A substance which exhibits "transverse piezoelectric effect"—a phenomenon, in which the largest distortion of the substance occurs in a direction perpendicular to the direction in which the voltage is applied—, such as Rochelle salt, may also be used.

The number of the piezoelectric crystal plates 66a may be more than 2. An increase in number of the plates 66a will result in a reduction in the impedance of the diaphragm 68.

While preferred embodiments of the invention have been shown and described in considerable detail,it should be understood that various changes and modifications may occur to persons of ordinary skill in the art without departing from the spirit and scope of the invention as defined in the appended claims.

I claim:

1. A crystal sound producer comprising: a diaphragm consisting of a piezoelectric crystal plate; means for applying an audio-frequency signal voltage across said diaphragm to cause said diaphragm to vibrate and emit sound waves; means for providing at least linear means through which the sound waves from said diaphragm are radiated substantially in semicylindrical wave fronts; and a waveform transform film made of a hard synthetic resin secured to one face of said diaphragm, said film having parallel ridges raised on one face thereof away from said diaphragm, whereby the bottoms of the grooves defined between said ridges serve as said linear means.

2. A crystal sound producer as claimed in claim 1, in which said waveform transform film is made of polystyrene, nylon, polycarbonate, or polyester, and has a thickness of 10 to 200 micrometers, and in which said ridges have a semicircular, semielliptic, triangular, or polygonal cross section.

3. A crystal sound producer comprising a diaphragm consisting of a piezoelectric crystal plate; means for applying an audio-frequency signal voltage across said diaphragm to cause said diaphragm to vibrate and emit sound waves; and means for providing at least one linear means through which the sound waves from said diaphragm are radiated substantially in semicylindrical wavefronts; wherein a waveform transform sheet made of a foamed, hard synthetic resin is secured to the front face of said diaphragm, said sheet has a plurality of parallel ridges and a plurality of parallel grooves between said ridges on one face thereof away from said diaphragm, and said sheet further has a slit formed therethrough at a portion thereof where the central one of said grooves lies, whereby said grooves and said slit serve as said linear means.

4. A crystal sound producer as claimed in claim 3, in which said waveform transform sheet comprises a press-formed foamed polystyrene, foamed nylon, foamed polycarbonate, or foamed polyester, and has a thickness of 2 to 5 mm, said ridges have a triangular, polygonal, semicircular, or semielliptic cross section.

5. A crystal sound producer comprising a diaphragm consisting of a piezoelectric crystal plate; means for applying an audio-frequency signal voltage across said diaphragm to cause said diaphragm to vibrate and emit sound waves; and means for providing at least one linear means through which the sound waves from said diaphragm are radiated substantially in semicylindrical wavefronts; wherein said diaphragm and a waveform transform film are secured at the edge portions thereof to a mounting in side-by-side relationship; said film is made of a hard synthetic resin and has parallel ridges raised on one face thereof defining elongate grooves therebetween and a semi-annular peripheral ridge raised on said face thereof and surrounding said parallel ridges; a connecting member is interposed between said diaphragm and said waveform film at the central portions thereof so as to transmit mechanical vibrations therebetween, whereby the elongate grooves defined between said parallel ridges serve as said linear means.

6. A crystal sound producer as claimed in claim 5, in which said waveform transform sheet comprises press-formed polystyrene, nylon, polycarbonate, or polyester, and has a thickness of 10 to 200 micrometers; said parallel raised ridges and said semi-annular peripheral raised ridges have semicircular, semielliptic, triangular, or polygonal cross sections.

7. A crystal sound producer as claimed in claim 5, in which said connecting member comprises: a flat plate extending transversely over said parallel raised ridges and secured to said waveform transform film; and a boss projecting from the central portion of said flat plate and secured to the central portion of said diaphragm.

8. A crystal sound producer as claimed in claim 5, in which a protective plate having a plurality of parallel, equally spaced apart slits formed therein, is secured to said mounting, in close proximity to the face of said waveform transform film which faces outwardly.

9. A crystal sound producer comprising a diaphragm consisting of a piezoelectric crystal plate; means for applying an audio-frequency signal voltage across said diaphragm to cause said diaphragm to vibrate and emit sound waves; and means for providing at least one linear means through which the sound waves from said diaphragm are radiated substantially in semicylindrical wavefronts; said piezoelectric crystal plate comprising a plurality of series-connected piezoelectric crystal plate elements, and being secured at one end thereof to an inner rear wall of a housing which is open at the front thereof, and said means for providing one or more linear means comprising a waveform transform plate provided in said housing and having a generally V-shaped cross section which has a vertex and a pair of diverging shanks terminating in edges parallel to said vertex, with the shanks of said V bulging generally outward of said housing, the vertex of said waveform transform plate being secured to said piezoelectric crystal plate, both edges of said plate parallel to said vertex being secured to their respective side walls of said housing in proximity to said open front thereof, whereby said vertex of said waveform transform plate serves as said linear means.

* * * * *